US005457616A

United States Patent [19]

Grigorescu et al.

[11] Patent Number: 5,457,616

[45] Date of Patent: Oct. 10, 1995

[54] MOTOR VEHICLE HEADLIGHT FITTED WITH IMPROVED COOLING AND VENTILATION MEANS

[75] Inventors: Benony Grigorescu; Marie-Catherine Nicoli, both of Brussels, Belgium

[73] Assignee: Valeo Vision, Bobigny, France

[21] Appl. No.: 92,203

[22] Filed: Jul. 15, 1993

[30] Foreign Application Priority Data

Jul. 17, 1992 [FR] France ..... 92 08836

[51] Int. Cl.[6] ..... F21V 29/00

[52] U.S. Cl. ..... 362/294; 362/61; 362/345

[58] Field of Search ..... 362/61, 96, 294, 362/264, 345, 373

[56] References Cited

U.S. PATENT DOCUMENTS

| | | | |
|---|---|---|---|
| 3,628,601 | 12/1971 | Snaper et al. | 362/345 |
| 4,862,337 | 8/1989 | Ohshio et al. | 362/294 |
| 4,931,912 | 6/1990 | Kawakami et al. | 362/294 |
| 4,937,710 | 6/1990 | Hurley et al. | 362/373 |
| 4,979,905 | 12/1990 | Vielhauer | 439/206 |
| 5,003,446 | 3/1991 | Nagengast et al. | 362/294 |
| 5,010,453 | 4/1991 | Ketterman | 362/61 |
| 5,041,949 | 8/1991 | Hirota et al. | 362/294 |
| 5,095,410 | 3/1992 | Nagengast et al. | 362/61 |
| 5,113,320 | 5/1992 | Haydu | 362/294 |
| 5,183,328 | 2/1993 | Osteen | 362/294 |

FOREIGN PATENT DOCUMENTS

| | | |
|---|---|---|
| 0286540 | 4/1988 | European Pat. Off. . |
| 3138360 | 9/1981 | Germany . |
| 2069120 | 1/1981 | United Kingdom . |
| 2089957 | 12/1981 | United Kingdom . |

*Primary Examiner*—Ira S. Lazarus
*Assistant Examiner*—Alan B. Cariaso

[57] ABSTRACT

A motor vehicle headlight of the type comprising a lamp, a reflector, a cover pressed against the rear of the headlight, and a closure glass, together with cooling and ventilation means for the inside space of the headlight as defined at least by the reflector.

According to the invention, the ventilation means comprise:

an air inlet first channel extending via at least one angle between a first opening to the outside that opens out essentially downwards, and a region of said inside space situated beneath the lamp; and an air outlet second channel extending along a sinuous path between a region of the inside space situated above the lamp and a second opening to the outside distinct from the first.

20 Claims, 1 Drawing Sheet

MOTOR VEHICLE HEADLIGHT FITTED WITH IMPROVED COOLING AND VENTILATION MEANS

The present invention relates in general terms to ventilating and cooling motor vehicle headlights.

BACKGROUND OF THE INVENTION

A certain number of headlights are already known that are fitted with a ventilation channel between the space inside the headlight and the outside. Conventionally, such a ventilation channel must be designed to ensure that air can flow in both direction between said inside space and the outside so as to cope with pressure increases and decreases caused by changes in the temperature of the headlight on being switched on and off in succession, while simultaneously ensuring that no moisture condenses on the cold walls of the headlight. At the same time, such a channel must also keep the inside space of the headlight, and more particularly its lamp, at a temperature that is reasonable, particularly for the purpose of ensuring that the lamp retains a normal lifetime.

Simultaneously, such a ventilation channel must be designed to avoid any water, mud, etc. . . . penetrating into the inside space of the headlight, particularly when the vehicle is travelling in the rain or while the engine compartment is being cleaned by means of a high pressure jet, or the like.

A known solution to this problem consists in defining at least one annular channel that opens to the outside in a bottom region and that opens to the inside space of the headlight in a top region. This may be done, for example, by means of appropriate dispositions obtained by molding on the rear face of the reflector and by an appropriate shape for a closure cover or cup pressed against said rear face.

Document FR-A-2 600 145 in the name of the Applicant describes a headlight of that type.

However, presently known ventilation devices having a single cooling and ventilation channel suffer from the major drawback of not cooling the lamp sufficiently. The lamp therefore operates at a high temperature and its lifetime is thus reduced.

OBJECT AND SUMMARY OF THE INVENTION

The main object of the present invention is to mitigate that drawback of the prior art while nevertheless not degrading the other qualities of known cooling/ventilation devices.

To this end, the present invention provides a motor vehicle headlight of the type comprising a lamp, a reflector, a cover pressed against the rear of the headlight, and a closure glass, together with cooling and ventilation means for the inside space of the headlight as defined at least by the reflector, wherein the ventilation means comprise:

an air inlet first channel extending via at least one angle between a first opening to the outside that opens out essentially downwards, and a region of said inside space situated beneath the lamp; and an air outlet second channel extending along a sinuous path between a region of the inside space situated above the lamp and a second opening to the outside distinct from the first.

Preferably, the second opening communicates with the first opening via a liquid removal channel that extends generally downwards.

In a specific embodiment, the channels are defined at least in part by three essentially coaxial skirts extending rearwards from a rear region of the reflector, and by said cover which is pressed against and clamped to said skirts, in which case, it is advantageous for the cover to form at least a portion of the means for fixing the lamp.

The lamp may include a base having a collar that presses against an end face of the inner skirt, the channels thus being defined in part by the lamp.

Advantageously, the first channel is defined by a first channel portion extending between said first opening that opens to the outside and formed in a lower region of the outer skirt and an opening formed in an upper region of the intermediate skirt, and by a second channel portion extending between said opening formed in an upper region of the intermediate skirt and an opening formed in a lower region of the inner skirt.

In which case, a web connects the outer skirt to the intermediate skirt, and the intermediate skirt to the inner skirt, in the vicinity of said opening formed in the intermediate skirt.

Preferably, the second channel is defined through an opening formed in the inner skirt on the side of the web that is opposite to said opening formed in the intermediate skirt, an opening formed in the intermediate skirt on the same side of the web but out of alignment with the opening formed in the inner skirt, by a channel portion extending generally downwards between the intermediate skirt and the outer skirt, and by a chimney putting said channel portion into communication with the outside in a generally upward direction.

It is then advantageous for said channel portion to include baffle-forming means defined by portions projecting into said channel portion from the outer skirt and from the intermediate skirt.

Said channel portion may extend downwards beyond the chimney between said outer skirt and said intermediate skirt as far as said opening formed in the lower region of the outer skirt, thereby defining said liquid-removal channel. Which channel may then include a web between said chimney and said opening formed in the lower region of the outer skirt, the web extending generally downwards from the intermediate skirt and partially closing said channel

BRIEF DESCRIPTION OF THE DRAWINGS

Other aspects, objects, and advantages of the present invention appear more clearly on reading the following detailed description of a preferred embodiment thereof given by way of example and described with reference to the accompanying drawing, in which.

MORE DETAILED DESCRIPTION

Figure 1:
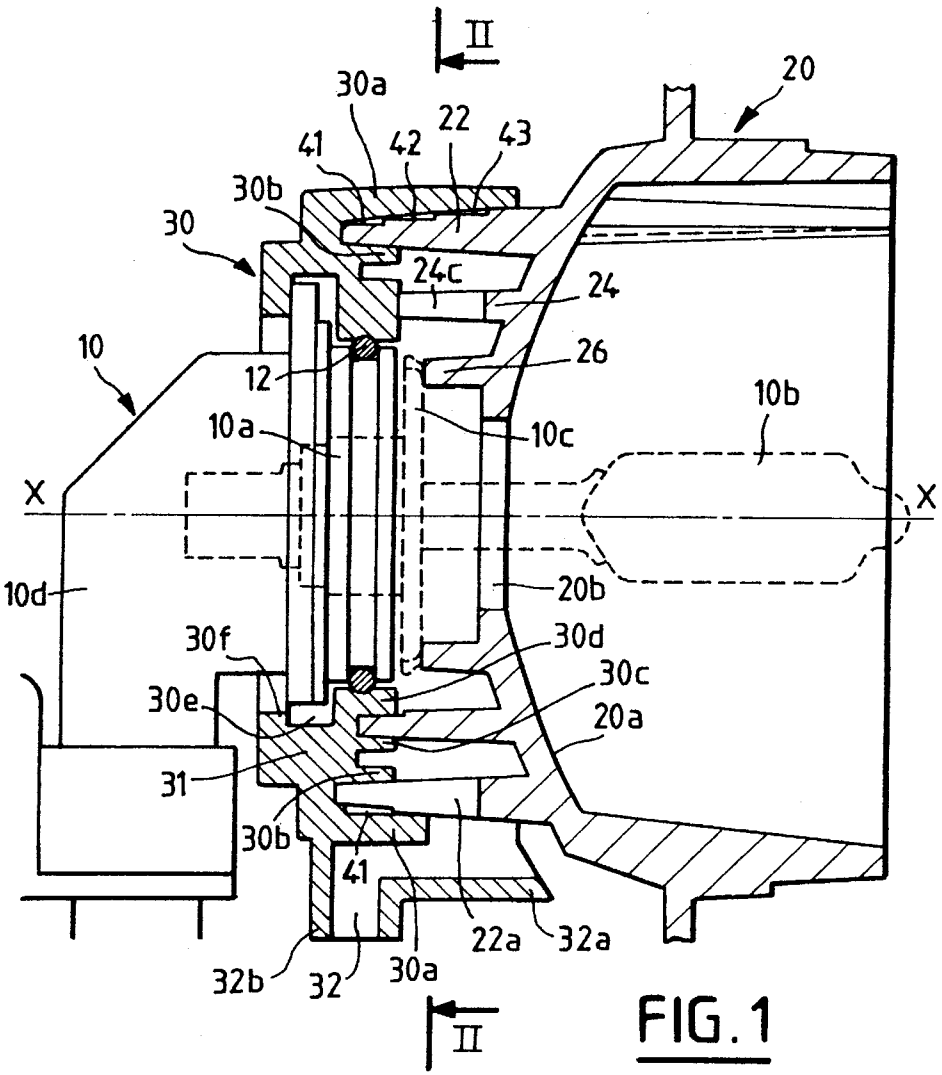
FIG. 1 is a vertical axial section view through a portion of a headlight fitted with ventilation means of the invention.

With reference to the drawing, a portion of a headlight is shown comprising a lamp 10, a reflector 20, and a cover 30 for being pressed against a rear face of the reflector. A glass (not shown) is designed to be connected in sealed manner to the reflector or to an intermediate piece, thereby closing the space inside the headlight In this example, the lamp 10 is of the type 9006 (US standard). Naturally, other types of lamps could be used. The lamp comprises a base 10*a* for pressing via a shoulder 10*c* against an annular surface provided at the rear of the reflector, and a bulb 10*b* containing a filament that co-operates with a reflecting surface 20*a* of the reflector for the purpose of generating a beam. Behind the base 10*a*, there extends an angle connector given overall reference 10*d* for feeding electricity to the lamp In addition to the reflecting surface 20*a* and a hole 20*b* for the lamp, the reflector 20 also includes three coaxial and approximately cylindrical skirts 22, 24, and 26 which extend rearwards from the back of the reflector. These skirts preferably share a common axis X—X which also constitutes the axis of the lamp and the optical axis of the reflector.

The three skirts 22, 24, and 26 are preferably obtained by molding while manufacturing the reflector. To facilitate unmolding, they taper slightly in section from front to back (or from right to left in FIG. 1). To simplify the description, the skirts are nevertheless referred to below as being cylindrical.

FIG. 1 also shows that the outside face of the outer skirt 22 has a stepped profile that co-operates with a rim 30*a* of the cover which has a smooth inside face and which is described in greater detail below to define three concentric annular channels 41, 42, and 43. This three-channel system is designed to prevent any liquid penetrating into the inside space of the headlight. More precisely, the channels 43 and 42 are intended to "fatigue" any water that may penetrate from the outside between the skirt 22 and the rim 30*a*, while the channel 41 serves to evacuate said water by opening to the outside in the bottom region of the skirt 22, as shown.

As can also be seen in FIG. 1, the three skirts 22, 24, and 26 extend rearwardly by respective different amounts: the outer skirt 22 extends furthest, the inner skirt 26 extends the least, and the intermediate skirt 24 has an intermediate amount of extension.

The cover 30 has three purposes: closing the inside space of the headlight where the lamp is assembled to the reflector; holding the lamp 10 in position; and co-operating with the rear terminal regions of the three skirts 22, 24, and 26 to define ventilation channels as described below. More precisely, going from a body 31 that extends essentially radially, the cover 30 comprises an outer rim 30*a* that is directed axially forwards and that is suitable for coming into contact with the outside face of the skirt 22, an axial rib 30*b* designed to come into contact with the inside face of the skirt 22, and finally two ribs 30*c* and 30*d* which come into contact with the outside and inside terminal faces respectively of the intermediate skirt 24.

By enclosing the terminal regions of the skirt 22 and 24, the rim 30*a* and the ribs 30*b–d* serve to fix the cover 30 firmly and in sealed manner on the back of the reflector.

The innermost inside face of the rib 30*d* is plane and is designed to press against a toroidal sealing ring 12 that provides, in conventional manner, a portion of the base 10*a* of the lamp. The shoulder 10*c* of the lamp presses against the terminal radial face of the inner skirt 26.

The skirts 22, 24, and 26 co-operate with the body 31 of the cover, the collar 10*c*, and the portion of the reflector that defines the reflecting surface 20*a* to form closed circularly-arcurate channels that allow air and liquids to flow, as described in detail below.

The cover 30 includes other dispositions for holding the base 10*a* of the lamp, and in particular a recess 30*e* which is rearwardly defined by a reentrant collar 30*f*.

The dispositions provided on and in the skirts 22, 24, and 26 for providing ventilation and cooling of the inside space of the headlights, and most particularly of the lamp 10 are now described with reference to FIG. 2.

The bottom portion of the outer skirt 22 includes an opening 22*a* that constitutes a cold air inlet. In FIG. 1, it can be seen that this opening communicates with an angled cold air inlet passage 32 that is open at both ends (i.e. its axially forward end and its downward end at the back), the passage being provided in the lower region of the cover 30 and being defined by two walls 32*a* and 32*b*.

A first web 23*a* connects together the skirts 22 and 24 in an essentially radial direction in the upper region of the cover. This web extends between the skirts 24 and 26 at 25*a*. An opening 24*a* is made through the skirt 24 immediately adjacent to the web 23*a*–25*a* (to the right of the web in FIG. 2). An opening 26*a* is also formed in the inner skirt 26 in a position that corresponding approximately to a southwesterly direction in FIG. 2. This opening opens out to the inside space of the headlight in the vicinity of the lamp hole 20*b*, and immediately behind it.

The skirts 22, 24, and 26 provided with the above dispositions, and the cover 30 co-operate to define a labyrinthine first communication path between the outside and the inside space of the headlight, this path or baffle being defined by a first circularly arcuate channel portion C1 defined by the skirts 22 and 24 and extending in this case over a little less than 180° between the openings 22*a* and 24*a*, and by a second circularly arcuate channel portion C2 defined by the skirts 24 and 26, running along the channel portion C1 and extending, in this case, over a little less than 225° between the openings 24*a* and 26*a*.

The path defined by channel portions C1 and C2 and the associated openings essentially constitutes a relatively large section inlet path for fresh air for the purpose of cooling the headlight and in particular its lamp.

Figure 2:
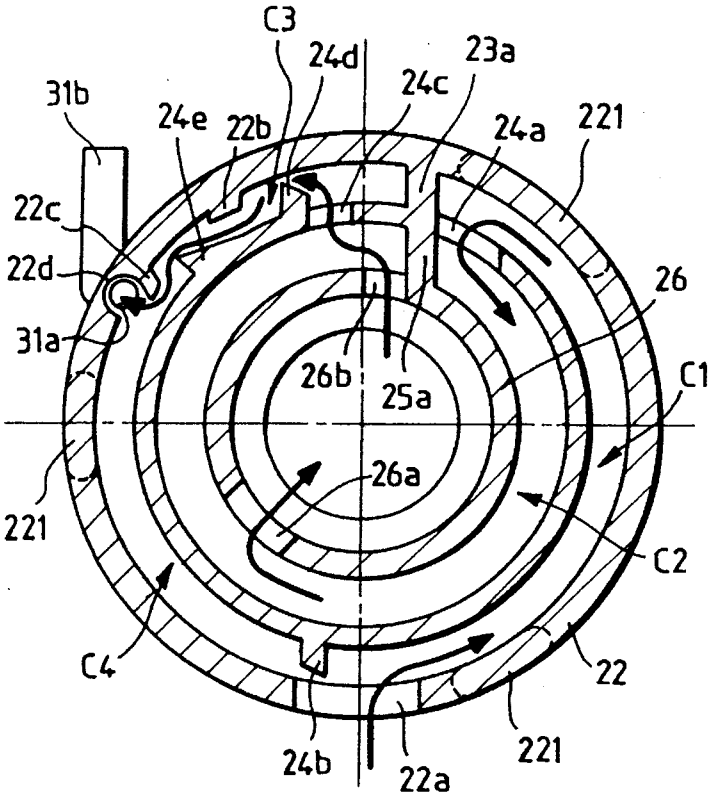
FIG. 2 is a vertical cross-section view on line II—II of FIG. 1.

Another opening 26*b* is provided in the skirt 26 immediately adjacent to the web 25*a* (to the left of it in FIG. 2). The skirt 24 also defines an opening 24*c* which is positioned with a small amount of offset relative to the opening 26*b* (to the left in the figure), thereby defining a first portion of a sinuous path.

A channel portion C3 is defined between the skirts 22 and 24 going from the opening 24*c* to an opening 31*a* formed in the body 31 of the cover 30 and positioned so as to open out into a reinforcement 22*d* of the skirt 22. This opening 31*a* communicates with a chimney (shown diagrammatically at 31*b*) that preferably extends upwards and that is formed in a corresponding location of the cover 30.

Channel portion C3 also defines a sinuous path by means of a plurality of projections integrally molded on the skirts 22 and 24. More precisely, a web 24*d* projects upwards from the intermediate skirt 24 across a substantial fraction of the width of channel portion C3 and immediately adjacent to the opening 24*c* (to the left in FIG. 2). A rib 22*b* extends downwards in channel portion C3 downstream from web 24*d*. Thereafter, a ramp-shaped portion 24*e* projects upwards from the intermediate skirt 24 downstream from the rib 22*b*. Finally, another web 22*c* partially closes off channel portion C3 by projecting from the outer skirt 22 immediately upstream from the reinforcement 22*d*.

It will be observed that in order to terminate only beyond the outlet 31*a* leading to the chimney 31*b*, channel portion C3 is extended by a channel portion C4 that continues to be defined between the skirts 22 and 24 until it reaches the lower opening 22*a*. In portion C4, immediately upstream from the opening 22*a*, a downwardly extending web 24*b* projects from the intermediate skirt 24 so as to locally define the section of said portion C4 for purposes that are explained below.

Finally, it will be observed that the annular end edge of the outer skirt 22 includes a plurality of projecting pegs 221 serving essentially to clamp the cover 30 onto the skirt 22 without requiring further fixing means, the cover 30 being provided with dents that are essentially complementary to the pegs. The pegs also serve as keying means when installing the cover.

The behavior of the headlight as described above is explained below.

Air heated by the lamp in the inside space of the headlight escapes via the path 26*b*, 24*c*, C3, 22*d*, and 31*a*.

Cooler air coming from the outside simultaneously penetrates into the inside space via the path 32, 22*a*, C1, 24*a*, C2, and 26*a*.

These two flows of hot air and of cold air respectively via two separate paths advantageously makes it possible to obtain a large flow rate of fresh air that is capable of keeping the inside space of the headlight, and in particular the lamp, at an operating temperature that is relatively low, thereby increasing lifetime.

In addition, the two-path design is such as to avoid any water or dirt (mud, . . . ) penetrating into the inside space. More precisely, on the cold air inlet path, the passage 32 is designed to protect the opening 22*a* against direct jets of liquid, while the initial portion (C1) of said path and the passage 26*a* determine the directions of the rising flows.

On the hot air outlet path, the dispositions formed in channel portion C3 are intended to "fatigue" any water contained in the form of vapor in the outlet flow of hot air, said water being deposited on the walls of said channel portion and subsequently escaping by gravity via channel portion C4 to the opening 22*a*. This opening therefore serves simultaneously as a fresh air inlet opening and as a water drain opening. It will also be observed that the downwardly extending web 24*b* serves to allow water or other liquid to escape while appropriately isolating the fresh air inlet channel from the hot air outlet channel by suitably reducing the section of channel portion C4 locally.

In addition, the bottom web 24*b* co-operates with the projecting portions 22*c* and 22*b* situated in the upper region to throttle any reverse air flow that may be charged with water or with moisture, and that could flow along channel portions C4 and C3, by causing the water to fall back under gravity.

Naturally, protection from water spray is also provided by sealed co-operation between the cover 30 and the terminal regions of the skirts 22, 24, and 26, and also by sealed co-operation using the sealing ring 12, between the base 10*a* of the lamp and the cover 30.

It will further be observed that merely by placing the cover 30 axially on the rear of the reflector (which can be done automatically) it is possible simultaneously to fix the lamp 10 on the reflector and to build up the cooling and ventilation system as defined above while providing protection against liquid sprays and removing any liquid that may have penetrated therein.

Finally, it will be observed that the cooling and ventilation functions are performed without it being necessary to provide the slightest opening in the reflecting surface 20*a* of the reflector 20 since both incoming air and outgoing air pass through the lamp hole 20*b*. In this respect, it may be observed that merely by removing the lamp 10 it is possible simply by sealingly engaging a suitable endpiece in the lamp hole, to verify that the headlight has proper sealing between the reflector (or an appropriate intermediate part) and the glass.

Naturally, the present invention is not limited in any way to the embodiment described above and shown in the drawings, and the person skilled in the art will be able to make any variant or modification that comes within the spirit of the invention.

We claim:

1. A motor vehicle headlight, comprising a hollow reflector having a lamp hole, a lamp fixed in said lamp hole by lamp fixing means, a cover applied against a rear region of said reflector, and a closure glass mounted at the front of the reflector, and further including means for cooling and ventilating an inside space defined by said reflector and said closure glass, said cooling and ventilation means being defined by cooperating arrangements provided at the rear region of said reflector and in said cover, said cooperating arrangements defining;

a first opening which opens out essentially downward, to the outside of the headlight, a first channel for air inlet extending via at least one angle between said first opening and a region of said inside space situated beneath said lamp, a second opening distinct from said first opening, which opens out to the outside of said headlight, a second channel for air outlet extending along a sinuous path between a region of said space situated above said lamp and said second opening, wherein the second opening communicates with the first opening via a liquid removal channel that extends generally downwards.

2. A headlight according to claim 1, wherein the channels are defined at least in part by three essentially coaxial skirt extending rearwards from a rear region of the reflector, and by said cover which is pressed against and clamped to said skirts.

3. A headlight according to claim 1, wherein the cover forms at least a portion of the means for fixing the lamp.

4. A headlight according to claim 1, wherein the lamp includes a base having a collar that presses against an end face of the inner skirt, the channels thus being defined in part by the lamp.

5. A headlight according to claim 1, wherein the first channel is defined by the first channel first portion extending between said first opening that opens to the outside and formed in a lower region of the outer skirt and a first opening formed in an upper region of the intermediate skirt, and by a first channel second portion extending between said opening formed in an upper region of the intermediate skirt and an opening formed in a lower region of the inner skirt.

6. A headlight according to claim 5, wherein a web connects the outer skirt to the intermediate skirt, and the intermediate skirt to the inner skirt, in the vicinity of said first opening formed in the intermediate skirt.

7. A headlight according to claim 6, wherein the second channel is defined through an opening formed in the inner skirt on the side first of the web that is opposite to said opening formed in the intermediate skirt, a second opening formed in the intermediate skirt on the same side of the web but out of alignment with the opening formed in the inner skirt, by a further channel portion extending generally downwards between the intermediate skirt and the outer skirt, and by a chimney putting said channel portion into communication with the outside in a generally upward direction.

8. A headlight according to claim 7, wherein said channel portion includes baffle-forming means defined by portions projecting into said further channel portion from the outer skirt and from the intermediate skirt.

9. A headlight according to claim 7, wherein the second opening to the outside communicates with the first opening to the outside via a liquid removal channel that extends generally downwards and wherein said further channel portion extends downwards beyond the chimney between said outer skirt and said intermediate skirt as far as said opening to the outside formed in the lower region of the outer skirt, thereby defining said liquid-removal channel.

10. A headlight according to claim 9, wherein a web is provided in said liquid removal channel between said chimney and said opening to the outside formed in the lower region of the outer skirt, the web extending generally downwards from the intermediate skirt and partially closing said channel.

11. A motor vehicle headlight, comprising a hollow reflector having a lamp hole, a lamp fixed in said lamp hole by lamp fixing means, a cover applied against a rear region of said reflector, and a closure glass mounted at the front of the reflector, and further including means for cooling and ventilating an inside space defined by said reflector and said closure glass, said cooling and ventilation means being defined by cooperating arrangements provided at the rear region of said reflector and in said cover, said cooperating arrangements defining;

a first opening which opens out essentially downwards to the outside of the headlight, a first channel for air inlet extending via at least one angle between said first opening and a region of said inside space situated beneath said lamp, a second opening distinct from said first opening, which opens out to the outside of said headlight, a second channel for air outlet extending along a sinuous path between a region of said space situated above said lamp and said second opening, wherein the channels are defined at least in part by three essentially coaxial skirts extending rearwards from a rear region of the reflector, and by said cover which is pressed against and clamped to said skirts.

12. A headlight according to claim 11, wherein the second opening communicates with the first opening via a liquid removal channel that extends generally downwards.

13. A headlight according to claim 11, wherein the cover forms at least a portion of the means for fixing the lamp.

14. A headlight according to claim 12, wherein the lamp includes a base having a collar that presses against an end face of the inner skirt, the channels thus being defined in part by the lamp.

15. A headlight according to claim 14, wherein the first channel is defined by a first channel portion extending between said first opening that opens to the outside and formed in a lower region of the outer skirt and an opening formed in an upper region of the intermediate skirt, and by a second channel portion extending between said opening formed in an upper region of the intermediate skirt and an opening formed in a lower region of the inner skirt.

16. A headlight according to claim 15, wherein a web connects the outer skirt to the intermediate skirt, and the intermediate skirt to the inner skirt, in the vicinity of said opening formed in the intermediate skirt.

17. A headlight according to claim 16, wherein the second channel is defined through an opening formed in the inner skirt on the side of the web that is opposite to said opening formed in the intermediate skirt, an opening formed in the intermediate skirt, on the same side of the web but out of alignment with the opening formed in the inner skirt, by a channel portion extending generally downwards between the intermediate skirt and the outer skirt and by a chimney putting said channel portion into communication with the outside in a generally upward direction.

18. A headlight according to claim 17, wherein said channel portion includes baffle-forming means defined by portions projecting into said channel portion from the outer skirt and from the intermediate skirt.

19. A headlight according to claim 18, wherein the second opening communicates with the first opening via a liquid removal channel that extends generally downwards and wherein said channel portion extends downwards beyond the chimney between said outer skirt and said intermediate skirt as far as said opening formed in the lower region of the outer skirt, thereby defining said liquid-removal channel.

20. A headlight according to claim 19, wherein a web is provided in said liquid removal channel between said chimney and said opening formed in the lower region of the outer skirt, the web extending generally downwards from the intermediate skirt and partially closing said channel.

* * * * *